US006981343B2

(12) United States Patent
Rawlings et al.

(10) Patent No.: US 6,981,343 B2
(45) Date of Patent: Jan. 3, 2006

(54) EXTENDED LINER SHELF TALKER

(75) Inventors: Timothy W. Rawlings, Waynesville, OH (US); Lance J. Esposito, Miamisburg, OH (US)

(73) Assignee: NCR Corporation, Dayton, OH (US)

( * ) Notice: Subject to any disclaimer, the term of this patent is extended or adjusted under 35 U.S.C. 154(b) by 119 days.

(21) Appl. No.: 10/732,498

(22) Filed: Dec. 10, 2003

(65) Prior Publication Data

US 2005/0126060 A1 Jun. 16, 2005

(51) Int. Cl.
*G09F 3/10* (2006.01)

(52) U.S. Cl. ..... 40/638; 40/661.03; 40/661.09; 283/81; 428/40.1; 428/41.8

(58) Field of Classification Search ..... 40/594, 40/638, 661.03, 661.09; 281/2; 283/56, 283/81; 428/40.1, 41.8, 42.2, 192
See application file for complete search history.

(56) References Cited

U.S. PATENT DOCUMENTS 2,755,576 A * 7/1956 Golden ..... 248/205.3
3,290,809 A 12/1966 King
3,753,305 A 8/1973 Mueh
4,179,138 A 12/1979 Bogdanovic
4,338,739 A 7/1982 Greenberger
4,477,048 A * 10/1984 Conway ..... 248/447.1
4,483,502 A * 11/1984 Fast ..... 248/223.41
4,541,598 A * 9/1985 Villanueva et al. .... 248/222.12
4,572,380 A 2/1986 Langwell
4,693,441 A 9/1987 Conway
4,716,669 A * 1/1988 Fast ..... 40/650
4,718,627 A 1/1988 Fast et al.
4,822,074 A * 4/1989 Hueffman et al. ..... 281/15.1
5,042,768 A 8/1991 Goldstein
5,284,689 A 2/1994 Laurash et al.
5,329,713 A * 7/1994 Lundell ..... 40/310
5,332,265 A 7/1994 Groess et al.
5,970,640 A 10/1999 Farrow
6,186,555 B1 * 2/2001 Rawlings ..... 283/81
6,408,553 B1 * 6/2002 Brown et al. ..... 40/661.03
6,737,140 B2 * 5/2004 Moliski ..... 428/43

* cited by examiner

*Primary Examiner*—Gary C. Hoge
(74) *Attorney, Agent, or Firm*—Francis L. Conte

(57) ABSTRACT

A shelf talker includes adhesive on the upper back side thereof, and a small release liner bonded thereto. The liner is severed by a cut line into top and middle tabs atop the adhesive, and a lower tab is suspended from the middle tab without adhesive between the tab and label.

20 Claims, 3 Drawing Sheets

FIG. 5
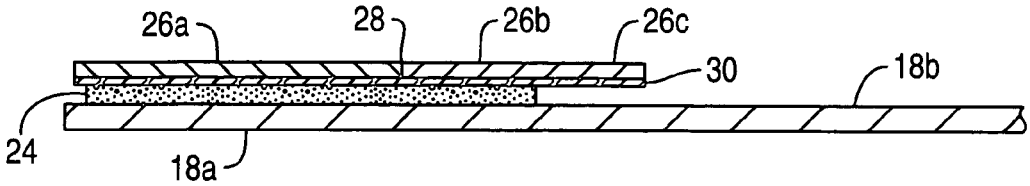
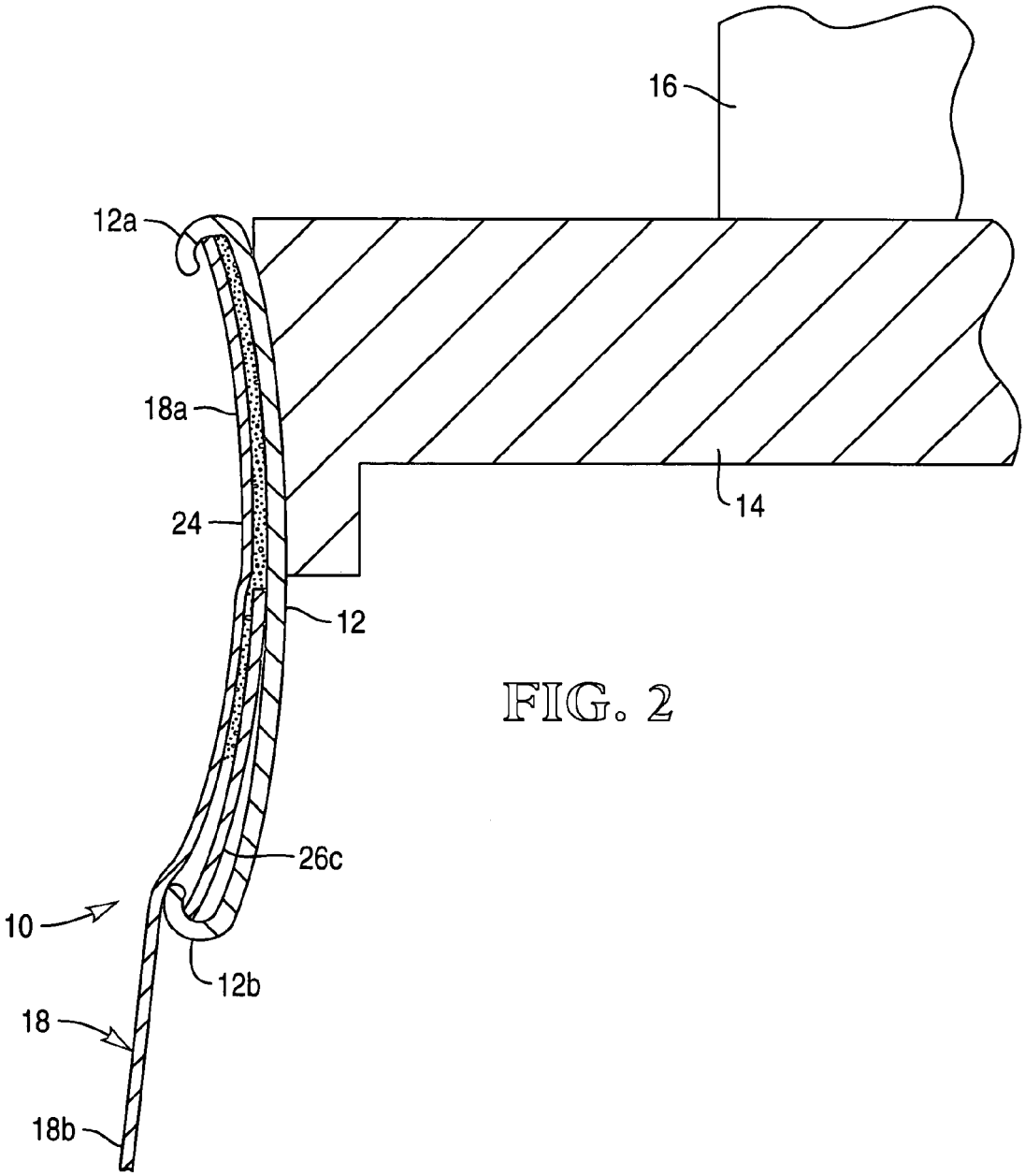
FIG. 2

EXTENDED LINER SHELF TALKER

BACKGROUND OF THE INVENTION

The present invention relates generally to product labels, and, more specifically, to shelf talkers.

The typical retail market includes aisles of shelves on which different products are displayed. Each shelf includes a C-shaped metal bracket in which individual product labels are suitably affixed. The typical shelf label is small in size to fit along the small bracket, and includes pressure sensitive adhesive on the back side thereof which forms a removable bond with the bracket.

A shelf talker is a special type of product label used for promoting brand identity, units of measure, price comparisons, and special sale pricing and promotions. The shelf talker is usually larger than the shelf label, and is used in addition thereto for increasing the visibility of the particular product being promoted.

Shelf talkers are typically provided in groups of similar size on individual sheets for collectively printing the desired information thereon. Fixed information, such as store identification and product graphics, is typically pre-printed in large quantities of the sheets in a suitable manner during the production of the shelf talkers.

Variable information, such as the specific product, size, and promotional price, may then be locally printed on each of the shelf talkers in a common sheet using a suitable printer such as thermal transfer, laser, and direct thermal printers.

Due to their temporary nature, shelf talkers must be easy to produce, install, and remove, and as well as being durable enough to withstand their intended use. And, cost is always a significant factor which affects shelf talker usage.

U.S. Pat. No. 6,186,555, assigned to the present assignee, discloses a plurality of shelf talkers ranged head-to-head in a unitary sheet for being commonly printed in the local printer. The individual shelf talkers may then be removed from the common sheet and temporarily applied to the shelf bracket.

U.S. Pat. No. 6,408,553, also assigned to the present assignee, discloses a particular configuration of the shelf talker in which a rectangular tab is provided in the label for mechanically mounting the shelf talker to the bracket. The release liner is initially removed from the back of the shelf talker for exposing pressure sensitive adhesive thereon, and the tab is bent for insertion into the bottom hook of the shelf bracket. The opposite top or leading edge of the shelf talker is disposed in the bracket top hook. The shelf talker is therefore both mechanically trapped in the shelf bracket as well as being bonded thereto using the adhesive.

The introduction of the integral tab in the label itself correspondingly increases the cost of manufacture of the shelf talker, as well as reduces the available surface area of the label for printing desired product information thereon. The tab may be formed by a three-edge diecut in the label, and printing thereon is not desired in view of the discontinuity provided by the diecut.

Furthermore, the die cut tab can create feed problems in printers having circuitous travel paths. As the shelf talker bends around narrow rollers in the feedpath, the diecut may expose the cut edges which may snag during feeder travel. This can cause jamming or skewing of the shelf talker during printer travel rendering the specific shelf talker unusable, and requiring remedial action when the printer jams.

Accordingly, it is desired to provide an improved shelf talker which eliminates die cutting of the label itself and retains the full surface area of the label for printing of desired promotional information.

BRIEF SUMMARY OF THE INVENTION

A shelf talker includes adhesive on the upper back side thereof, and a small release liner bonded thereto. The liner is severed by a cut line into top and middle tabs atop the adhesive, and a lower tab is suspended from the middle tab without adhesive between the tab and label.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which:

FIG. 2 is a elevational, cross sectional view of the shelf talker and bracket illustrated in FIG. 1, and taken along line 2—2.

FIG. 5 is a cross sectional view, like FIG. 4, of the shelf talker illustrated in FIG. 3 in accordance with another embodiment.

DETAILED DESCRIPTION OF THE INVENTION

Figure 1:
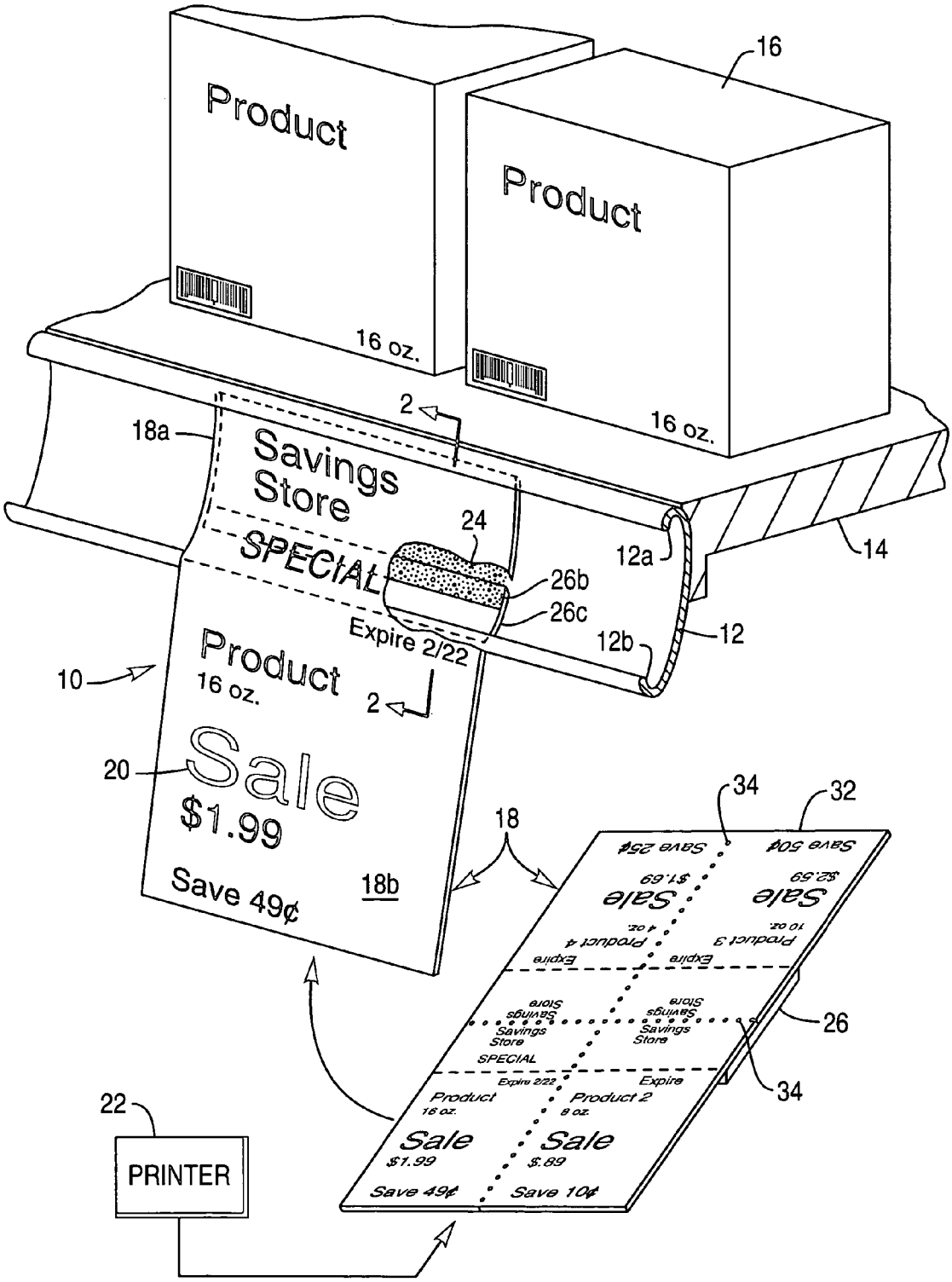
FIG. 1 is a partly schematic, isometric view of a shelf mounted shelf talker configured for on-site printing and use in a shelf bracket of a product shelf.

Illustrated in FIG. 1 is an exemplary display tag or shelf talker 10 removably mounted to a shelf bracket 12 disposed along the front edge of a display shelf 14 in an exemplary embodiment. The shelf talker 10 is typically provided to identify a special promotion of a corresponding product 16 displayed in batches atop the shelf 14, such as in a typical grocery store or supermarket.

The bracket 12 and shelf 14 may take any conventional form such as those illustrated. The typical bracket 12 is a metal extrusion which is C-shaped in cross section, with top and bottom J-hooks 12*a,b*. The bracket is sized for receiving standard product shelf labels (not shown) which permanently designate the location of the shelf space reserved for a given product.

In a typical sale promotion of an individual product, it is desirable to use a corresponding shelf talker 10 which is typically larger in size than the shelf label and is temporarily mounted to the bracket for promoting the products. As shown in FIG. 1, the shelf talker 10 may have any suitable size and configuration, and is typically rectangular. The shelf talker includes a label 18 having a front side for promoting the product and an opposite back side for attachment to the bracket.

The label includes a rectangular top strip 18*a* which extends horizontally across the full width of the label and is integrally joined to a rectangular bottom leaflet 18*b* in a preferably unitary, one-sheet configuration.

The top strip 18*a* is sized and configured for being mounted to the bracket 12. And, the leaflet 18*b* is sized and configured for printing atop the front thereof any desirable product information 20 describing or promoting the specific products.

In the exemplary embodiment illustrated in FIG. 1, the label identifies the name of the particular store, the particular product, and a promotional sale price therefor for promoting a temporary price reduction. Other descriptions or promotions as desired may be printed atop the label 18.

Basic or common information on the labels may be pre-printed by the label manufacturer, and specific product information for the particular product and promotion may be locally printed on-site using any conventional printer 22. Typical printers include laser printers and dot matrix printers, as well as ink jet printers.

Figure 3:
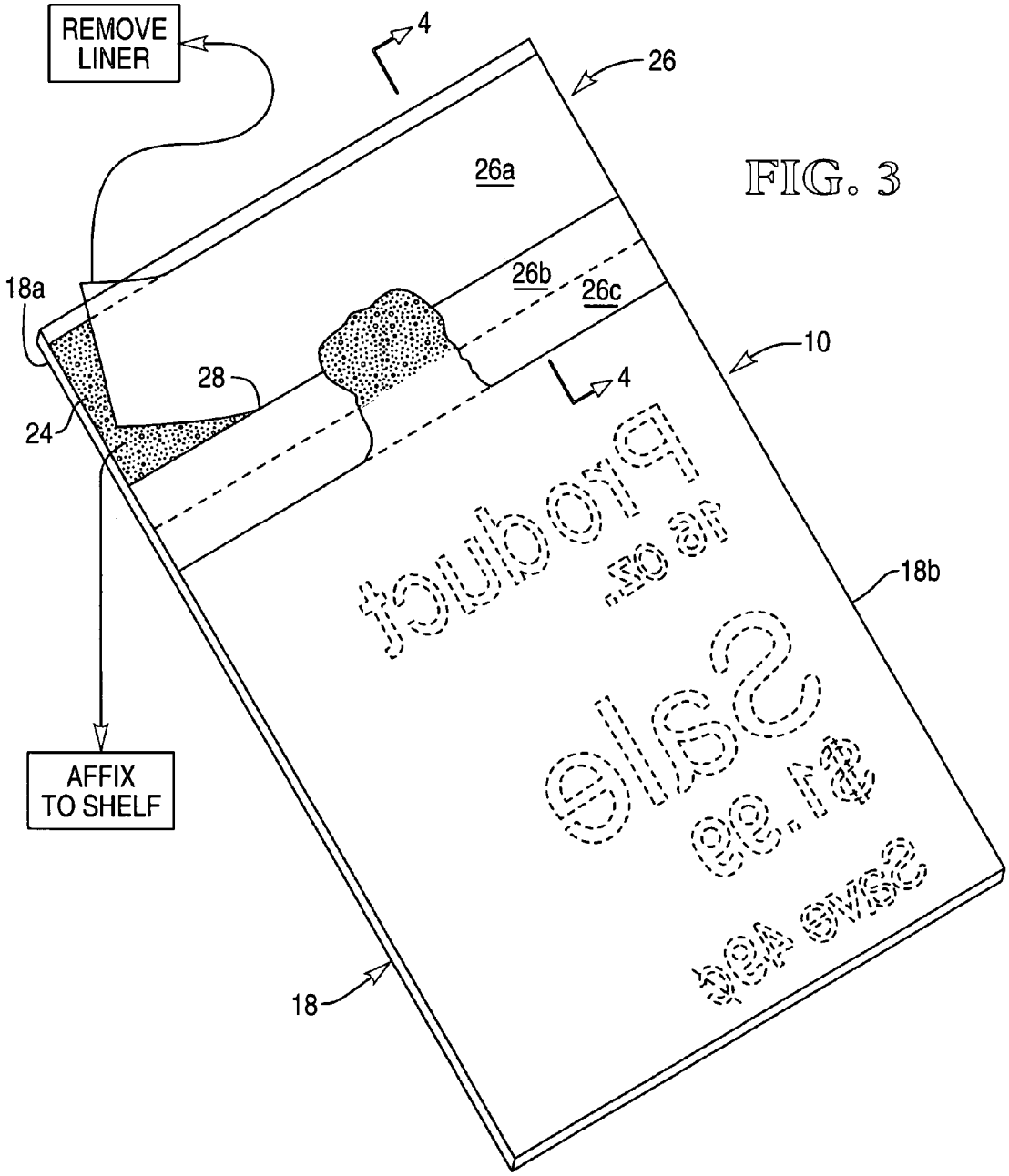
FIG. 3 is an isometric view of the backside of the shelf talker illustrated in FIG. 1, with a flowchart representation of an exemplary method of its use in the printer and shelf bracket.

FIGS. 1 and 2 illustrate the shelf talker after printing, and suspended in use from the shelf bracket. FIG. 3 illustrates the back side of the shelf talker just prior to mounting in the shelf bracket.

As illustrated in FIG. 3 the label 18 includes an adhesive 24 disposed only on the upper back side of the label in the form of a rectangular patch which extends the full width of the label. A relatively small release liner 26, compared to the substantially larger label on which it is found, is bonded to the back of the label by the adhesive 24.

Both the label top strip 18*a* and small release liner 26 are sized to fit the short height of the shelf bracket 12, and may have any suitable width along the bracket. The adhesive is disposed behind the upper portion of the top strip 18*a* for removably bonding the label to the bracket as illustrated in FIG. 2. The adhesive 24 may have any conventional composition, such as typical pressure sensitive adhesive for providing the removable bond with the metal bracket 12, yet such pressure sensitive adhesive will typically form a permanent bond to paper.

The small release liner illustrated in FIG. 3 includes top and middle portions or tabs 26*a,*26*b* separated or severed from each other by a corresponding cut line 28 therebetween. Both tabs 26*a,b* of the release liner are laminated or bonded to the back of the top strip 18*a* by the adhesive 24.

The release liner 26 further includes a lower tab or hanger 26*c* that provides a bottom extension of the release liner which is suspended from the middle tab 26*b* behind the lower portion of the top strip without any adhesive between the lower tab and the label. The release liner 26 is therefore bonded to the label top strip by the common adhesive behind the top and middle tabs 26*a,b*, except for the lower tab 26*c* which is devoid of the adhesive.

This basic construction of the shelf talker provides advantages in manufacture and use thereof in the printer 22 illustrated in FIG. 1. Since the cut line 28 is now found in the liner behind the label, the entire front surface area of the label 18 may now have printed thereatop any desired product information 20, including printing atop both the bottom leaflet 18*b*, as well as the top strip 18*a*.

The liner top tab 26*a* as illustrated in FIG. 3 may then be readily removed by peeling away from the back side of the label 18 to expose the adhesive behind the top strip 18*a*. The top or leading edge of the label 18 illustrated in FIG. 2 may then be inserted into the top hook 12*a* of the shelf bracket, with the lower tab or hanger 26*c* being correspondingly inserted into the bottom hook 12*b* of the bracket. The adhesive 24 exposed on the back side of the top strip 18*a* by removal of the top tab 26*a* may then be removably bonded to the shelf bracket by simply pressing the front surface of the top strip against the shelf bracket.

In this configuration, the pressure sensitive adhesive 24 temporarily bonds the upper portion of the top strip to the shelf bracket, while both the leading edge of the label and the suspended lower tab 26*c* provide an additional mechanical retention of the shelf talker to the shelf bracket irrespective of the adhesive.

Figure 4:
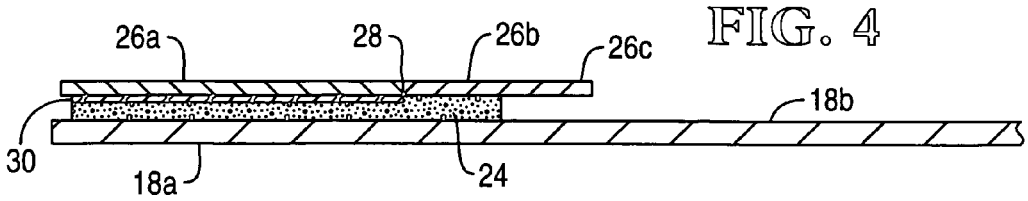
FIG. 4 is an cross sectional view of the upper portion of the shelf talker illustrated in FIG. 3 and taken along line 4—4.

In the preferred embodiment illustrated in FIGS. 3 and 4, the label 18 is in the form of a unitary face sheet, with the small liner 26 also being a single sheet disposed within the upper perimeter of the label defining the top strip 18*a*. In this way, the liner and label top strip have a two-ply configuration, whereas the bottom leaflet 18*b* is a single-ply extending downwardly from the two-ply lamination. The printable front surface of the label illustrated in FIG. 1 therefore provides a continuous flat surface which can be fed through the printer 22 without potentially obstructing features, such as the previously found tab diecut in the earlier shelf talkers.

Furthermore, the label is preferably imperforate without diecuts, perforations, or other discontinuities therein so that its entire front surface is fully printable as desired for maximizing the promotional information thereon.

In the preferred embodiment illustrated in FIG. 3, only the liner 26 itself is severed, with the cut line 28 extending the full width of the liner 26; with the top, middle, and lower tabs 26*a,b,c* extending the full horizontal width of the label 18.

The release liner 26 may have any conventional configuration, and preferably includes a suitable release coating 30 on the top tab 26*a* as shown in FIG. 4 for removably bonding the top tab to the adhesive 24 behind the top strip 18*a*. The release coating ensures that the adhesive 24 forms a removable bond with the liner so that the liner top tab 26*a* may be readily removed prior to use of the shelf talker.

Whereas the liner top tab 26*a* illustrated in FIG. 4 is removably bonded by the adhesive to the top strip 18*a*, the liner middle tab 26*b* is preferably permanently bonded by the same adhesive to the top strip 18*a*. This may be effected by the release liner 26 being devoid of the release coating on the middle tab 26*b*, as well as on the lower tab 26*c* which permits the adhesive to directly bond the lower portion of the top strip directly to the back side of the middle tab 26*b* which faces the back side of the label.

In the alternate embodiment illustrated in FIG. 5, the release liner 26 may have the release coating 30 covering its entire back surface which faces the back surface of the label. In this way, both the middle and lower tabs 26*b,c* as well as the top tab 26*a* are covered with the release coating as typically provided in conventional release liners. Although the top tab 26*a* is removable from the label top strip during installation of the shelf talker, the liner middle tab 26*b* remains bonded to the top strip and therefore continues to support the suspended or cantilevered lower tab 26*c*. Although the middle tab 26*b* is nevertheless removable from the adhesive on the top strip, sufficient bond strength remains therebetween for permitting the mechanical hanging function of the lower tab 26*c*.

In the preferred embodiment illustrated in the several figures, the label 18 is preferably formed of conventional card stock, in the exemplary range of 80–100 pounds per ream. Such card stock material is substantially thicker and stiffer than the flexible liner 26. In alternate embodiments, the label may be formed of other materials, such as typical bond paper in the exemplary range of 18–33 pounds per ream.

The release liner 26 itself may have any conventional composition, such as supercalendared kraft (SCK) paper which is relatively thin, and preferentially receives a liquid silicone coating without excessive bleeding. The liquid silicone is conventionally cured, by ultraviolet light for example, to form the smooth release coating with suitable release characteristics for the pressure sensitive adhesive 24 used in the preferred embodiment.

The configuration of the liner 26 illustrated in FIG. 3 and the adhesive 24 joining it to the label are specifically chosen for mounting the shelf talker to the bracket illustrated in FIGS. 1 and 2 mechanically, as well as adhesively in the preferred embodiment. In particular, the lower 26*c* is sized in height relative to the top edge of the label 18 for mounting the shelf talker in the shelf bracket 12 as illustrated in FIG. 2.

The top hook 12*a* of the bracket receives the top edge of the label during assembly, and the bottom hook 12*b* of the bracket receives the bottom edge of the lower tab 26*c*. In this way, the top strip of the label is mechanically trapped between the top and bottom hooks of the bracket. And, since the label material is preferably card stock, the stiffness of the top strip maintains the retention forces of the label top edge and the liner bottom edge in the hooks whether or not the liner top tab 26*a* is removed during use.

The shelf talker illustrated in front view in FIG. 1 and in back view in FIG. 3 may be as wide as desired for being mounted in the shelf bracket 12, which has a substantial length along the edge of the shelf for receiving a substantial number of conventional shelf labels, as well as the shelf talkers as desired. Correspondingly, the cut line 28 illustrated in FIG. 3 is preferably a continuous diecut across the full width of the liner 26 which permits the ready removal of the liner top tab 26*a* without tearing. In an alternate embodiment, the cut line 28 may be perforated, such as with micro-perforations, for permitting removal of the top tab 26*a* without removing the middle tab 26*b*, or the lower tab 26*c* integrally joined thereto.

Since the entire liner 26 illustrated in FIG. 3 is preferably sized to match the available space within the shelf bracket 12 illustrated in FIG. 1, the middle tab 26*b* and the lower tab 26*c* are suitably smaller in height than the top tab 26*a*. And, the middle and lower tabs 26*b,c* preferably have substantially equal size or height.

In this way, a substantial amount of the pressure sensitive adhesive 24 may be exposed on the back side of the label by the removal of the top tab 26*a* for providing a substantial adhesive bond with the top of shelf bracket. Correspondingly, the middle tab 26*b* is bonded to the back of the label with sufficient surface area of adhesive for in turn supporting the lower tab 26*c* which is devoid of adhesive.

The lower tab 26*c* may then be bent slightly away from the back surface of the top strip as illustrated in FIG. 2 for being inserted and retained by the bracket lower hook 12*b*. The bottom leaflet portion 18*b* of the label by definition is that portion extending downwardly from its juncture with the top strip where that junction rests outside the bracket lower hook 12*b*, with the lower tab 26*c* resting inside that hook.

The individual shelf talker 10 illustrated attached to the shelf in FIG. 1 may be formed in quantity in a unitary sheet 32 thereof. The sheet 32 may have a typical size, such as 8.5 by 11 inches, and a plurality of the labels, such as the four illustrated in FIG. 1, may be formed on each sheet. Preferably the shelf talkers are disposed head-to-head on the sheet and separated from each other by corresponding lines 34 of perforation.

Correspondingly, the release liner 26 preferably bridges the back side of the unitary sheet 32 in a common band bridging the head-to-head shelf talkers, with the perforation lines 34 also dividing the liner for later separation after printing.

The unitary sheet 32 illustrated in FIG. 1 presents a substantially continuous printing surface which may be readily transported through the printer 22 for printing thereon as desired. Substantially the entire face surface of the sheet 32 is available for printing, without loss of area due to the previously used diecuts therein. And, the release liners on the back side of the sheet contain the cut lines 28 therein which permit later removal of the corresponding liner top tabs 26 for use in the mounting the shelf talkers to the shelf brackets as described above.

The elimination of the face sheet diecut in the label eliminates the corresponding cost therefor. The full front surface of each label is available for printing. And, the retained portion of the liner is now available to provide a convenient and simple hanger for mechanically trapping the top strip of the label in the shelf bracket.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

What is claimed is:

1. A shelf talker comprising:

a label having adhesive on the upper back side thereof;

a small release liner bonded to the back of said label by said adhesive except for a lower tab thereof; and said liner having a cut line severing said liner into top and middle tabs atop said adhesive, with said lower tab being suspended from said middle tab.

2. A shelf talker according to claim 1 wherein said label comprises a unitary face sheet, and said liner is disposed within the upper perimeter thereof.

3. A shelf talker according to claim 2 wherein said label is imperforate.

4. A shelf talker according to claim 3 wherein said cut line extends the full width of said liner, and said top, middle, and lower tabs extend the full width of said label.

5. A shelf talker according to claim 4 wherein said label further comprises a top strip laminated to said liner in a two-ply configuration, and a single-ply bottom leaflet extending from said two-ply lamination.

6. A shelf talker according to claim 5 wherein said release liner includes a release coating on said top tab for removably bonding said top tab to said adhesive behind said top strip.

7. A shelf talker according to claim 6 wherein said release liner further includes release coating on said middle and lower tabs.

8. A shelf talker according to claim 6 wherein said release liner is devoid of said release coating on said middle tab for permanently bonding said middle tab to said top strip by said adhesive.

9. A shelf talker according to claim 6 wherein said label comprises card stock being substantially stiffer than said liner.

10. A shelf talker according to claim 9 wherein said liner comprises supercalendared kraft paper.

11. A shelf talker according to claim 6 wherein said cut line comprises a continuous diecut across the full width of said liner.

12. A shelf talker according to claim 6 wherein said middle and lower tabs have substantially equal size.

13. A shelf talker according to claim 6 wherein said lower tab is smaller than said top tab.

14. A shelf talker according to claim 6 wherein said middle tab is smaller than said top tab.

15. A shelf talker according to claim 6 comprising a unitary sheet having a plurality of said labels with a common release liner bridging the back side of thereof.

16. A shelf talker according to claim 6 wherein said lower tab is sized relative to the top edge of said label for mounting said shelf talker in a shelf bracket having a top hook receiving said label top edge, and a bottom hook receiving said lower tab.

17. A method of using said shelf talker according to claim 6 comprising:

printing product information atop said label;

removing said liner top tab from said label to expose adhesive behind said top strip;

inserting the top edge of said label in a top hook of a shelf bracket;

inserting said lower tab in a bottom hook of said bracket; and bonding said adhesive exposed on the back side of said top strip to said shelf bracket.

18. A shelf talker comprising:

a single-ply label including a top strip and a bottom leaflet, and adhesive disposed behind said top strip; and a release liner including top and middle tabs separated by a cut line therebetween, and laminated to said top strip by said adhesive, and further including a lower tab being suspended from said middle tab behind said top strip without adhesive therebetween.

19. A shelf talker according to claim 18 wherein:

said label comprises imperforate card stock being substantially stiffer than said liner; and said liner comprises supercalendared kraft paper with a silicone release coating on said top tab.

20. A shelf talker according to claim 19 wherein:

said liner top tab is removably bonded by said adhesive to said top strip; and said liner middle tab is permanently bonded by said adhesive to said top strip.

* * * * *